US007096946B2

(12) United States Patent
Jasser et al.

(10) Patent No.: US 7,096,946 B2
(45) Date of Patent: Aug. 29, 2006

(54) ROTATING BLAST LINER

(75) Inventors: Rami J. Jasser, Houston, TX (US); Martin P. Coronado, Cypress, TX (US); John V. Salerni, Kingwood, TX (US); John A. Nelson, Cypress, TX (US)

(73) Assignee: Baker Hughes Incorporated, Houston, TX (US)

( * ) Notice: Subject to any disclaimer, the term of this patent is extended or adjusted under 35 U.S.C. 154(b) by 80 days.

(21) Appl. No.: 10/748,099

(22) Filed: Dec. 30, 2003

(65) Prior Publication Data

US 2005/0145384 A1 Jul. 7, 2005

(51) Int. Cl.
*E21B 43/04* (2006.01)

(52) U.S. Cl. ..... 166/278; 166/51; 166/222

(58) Field of Classification Search ..... 166/380, 166/381, 278, 51, 242.1, 222
See application file for complete search history.

(56) References Cited

U.S. PATENT DOCUMENTS

| | | | | |
|---|---|---|---|---|
| 2,116,408 A | | 5/1938 | O'Leary et al. | 166/1 |
| 2,224,538 A | * | 12/1940 | Eckel et al. | 166/278 |
| 3,034,912 A | | 5/1962 | Flowers | |
| 3,101,784 A | * | 8/1963 | Davidson | 166/158 |
| 3,358,764 A | | 12/1967 | Parker | 166/42 |
| 3,382,930 A | | 5/1968 | Ribb et al. | 166/242 |
| 3,576,222 A | | 4/1971 | Acheson et al. | 175/67 |
| 3,727,691 A | | 4/1973 | Muecke et al. | 166/295 |
| 4,211,440 A | | 7/1980 | Bergstrom | 285/45 |
| 4,995,456 A | | 2/1991 | Cornette et al. | 166/51 |
| 5,016,921 A | | 5/1991 | Claycomb | 285/39 |
| 5,059,043 A | | 10/1991 | Kuhne | 285/45 |
| 5,549,333 A | | 8/1996 | Uherek, Sr. et al. | 285/45 |
| 5,636,691 A | * | 6/1997 | Hendrickson et al. | 166/278 |
| 5,730,223 A | * | 3/1998 | Restarick | 166/380 |
| 6,269,879 B1 | | 8/2001 | Boyd | 166/242.5 |
| 6,484,807 B1 | * | 11/2002 | Allen | 166/368 |
| 6,491,097 B1 | * | 12/2002 | Oneal et al. | 166/278 |

* cited by examiner

*Primary Examiner*—Hoang Dang
(74) *Attorney, Agent, or Firm*—Madan, Mossman & Sriram, P.C.

(57) ABSTRACT

An improved blast liner assembly for use in gravel packing or fracturing operations wherein solid materials, in slurry form, are flowed out of the flowbore of a working tool and into the annulus of a wellbore. The blast liner is a cylindrical member that provides a protective shield to the interior retaining section. An angular flow diverter is provided within the blast liner and has a plurality of angled flow diversion channels formed into the inner surface of the blast liner body. Flow of slurry through the blast liner will cause the blast liner to rotate within the retaining section due to the reaction forces imparted to the blast liner from diverting the slurry flow. In this manner, the impingement area presented by the blast liner is increased, and the life of the blast liner extended. The blast liner may also be caused to move axially within the retaining section to further increase the impingement area.

23 Claims, 5 Drawing Sheets

ROTATING BLAST LINER

BACKGROUND OF THE INVENTION

1. Field of the Invention

The invention relates generally to devices and methods for improved fracturing and/or gravel packing operations within a wellbore. In more particular aspects, the invention relates to the protection of devices that are used to place gravel or proppants in such operations.

2. Description of the Related Art

There are times during the life of a well that it is necessary to flow granular or pelletized solid materials, in a slurry, into a wellbore in order to improve wellbore operation or to extend the life of the well. Two of the more common techniques are gravel packing and fracturing of a formation using a fracturing fluid having proppant therein. During gravel packing, gravel is pumped down a tubing string into a wellbore and placed, where desired, using a cross-over tool with suitable exit ports for placement of the gravel in desired locations within the wellbore. In fracturing operations, a fracturing agent is flowed into the wellbore under very high pressure to fracture the formation that immediately surrounds the borehole, thereby creating improved flowpaths for hydrocarbons to enter the wellbore from the surrounding formation. The fracturing agent, a fluid, often contains a proppant, which is in granular or pelletized form. Typical proppants includes peanut shells, sand, ceramics, and other materials known in the art. Proppants are flowed into the fractures created by the fracturing agent and remain there after the fracturing agent has been removed from the wellbore in order to help prop the fractures open and allow the improved flow to continue.

While gravel packing and fracturing operations are often necessary, they do create significant erosion wear upon the components of the production assembly as the gravel or proppant is flowed into the wellbore. Erosion damage to the production assembly, if significant, can result in a loss of production containment in the wellbore. One area that tends to receive the most severe damage is around the exit port where the solid material exits the crossover tool and enters the inside of the production assembly. In order to counter this significant wear damage, devices have been developed that are better able to withstand the wear associated with these operations. Typically, a wear sleeve or blast liner will be placed proximate the exit port, or the exit port will actually be disposed through this wear sleeve or blast liner. There is, however, some disagreement over the preferred composition of a wear sleeve or blast liner that should be used. Materials that are harder, and less subject to deformation, also tend to be more brittle. Additionally, regardless of the material that is used to form the sleeve or liner, the concentration of erosive forces upon the liner/sleeve will always tend to shorten the life of the placement components.

The present invention addresses the problems of the prior art.

SUMMARY OF THE INVENTION

The invention provides an improved blast liner assembly for use in gravel packing or fracturing operations wherein solid materials, in slurry form, are flowed out of the flowbore of a working tool, into the production assembly, then into the annulus of a wellbore. In preferred embodiments, a gravel packing placement system includes an extension sleeve that is landed in a wellbore and a service tool that is run inside the extension sleeve. The service tool defines an axial flowbore and a lateral gravel exit port. The extension sleeve has an interior retaining section that contains a rotatable blast liner.

The blast liner is a cylindrical member that provides a protective shield to the interior retaining section. It is typically fashioned from a hardened, resilient material, such as 4140 steel. The blast liner includes an impingement area that may be coated with a protective coating, such as a ceramic or tungsten coating. Additionally, an angular flow diverter is provided within the blast liner, preferably proximate the lower end. In preferred embodiments, the flow diverter is a plurality of angled flow diversion channels formed into the inner surface of the lower end of the blast liner body. The flow diversion channels may be provided by several radially inwardly-projecting vanes or, in the alternative, grooves that are milled into the interior surface of the lower end. Flow of slurry through the blast liner will cause the blast liner to rotate within the retaining section due to the reaction forces imparted to the blast liner from diverting the slurry flow. In this manner, the impingement area presented by the blast liner is increased, and the life of the blast liner extended.

Several exemplary constructions for a rotatable blast liner assembly are described herein. In one embodiment, the liner is rotatable within a fixed axial space in the retaining section. Bearing members are disposed between the blast liner and the retaining section to assist rotation. In a second described embodiment, the blast liner assembly includes a wearable, or erodable, bushing that is disposed below the blast liner in the liner retaining section. As the liner rotates within the liner retaining section, the bushing wears away, resulting in axial movement of the blast liner within the liner retaining section. This axial movement further increases the impingement or wear area provided by the blast liner. In a further described embodiment, the liner retaining section is provided with a circuitous lug track and the blast liner is provided with an outwardly projecting lug that resides within the lug track. Rotation of the blast liner within the liner retaining section thereby results in controlled axial movement of the blast liner within the liner retaining section. Again, the axial movement of the blast liner acts to increase the impingement or wear area provided by the blast liner.

BRIEF DESCRIPTION OF THE DRAWINGS

For a thorough understanding of the present invention, reference is made to the following detailed description of the preferred embodiments, taken in conjunction with the accompanying drawings, wherein like reference numerals designate like or similar elements throughout the several figures of the drawings and wherein.

DETAILED DESCRIPTION OF THE PREFERRED EMBODIMENTS

Figure 1A:
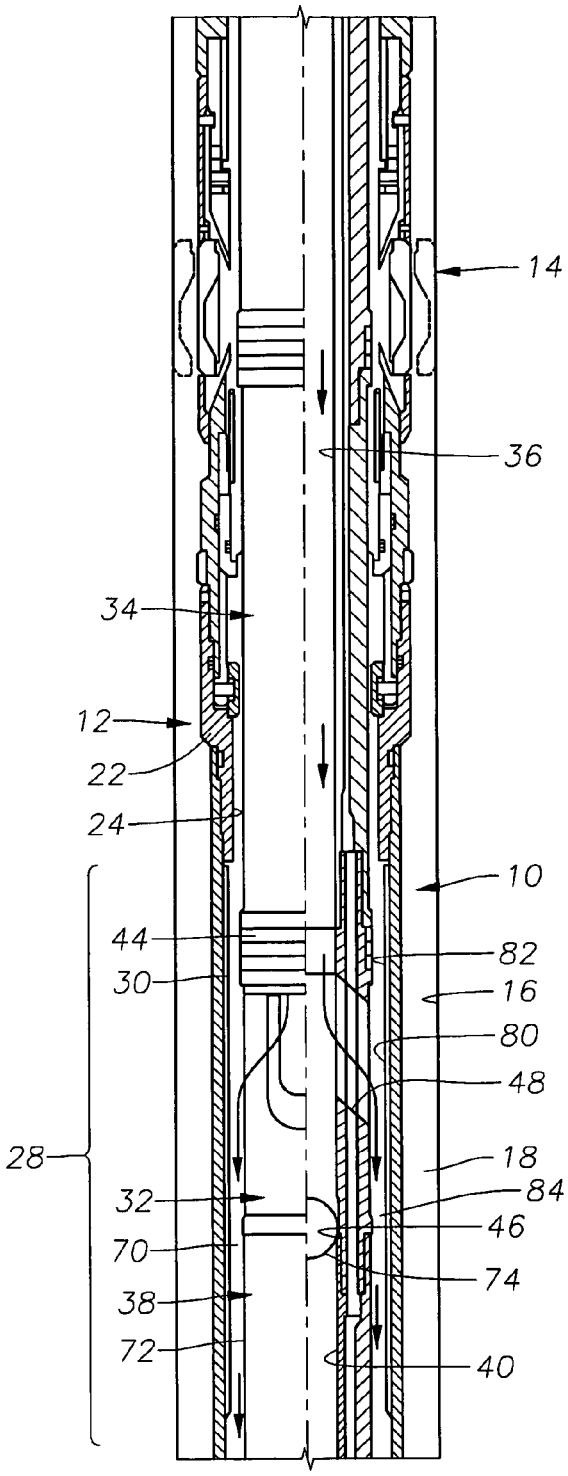
FIGS. 1*a* and 1*b* are side, cross-sectional views of a wellbore having an exemplary solids placement tool suspended therein.
Figure 1B:
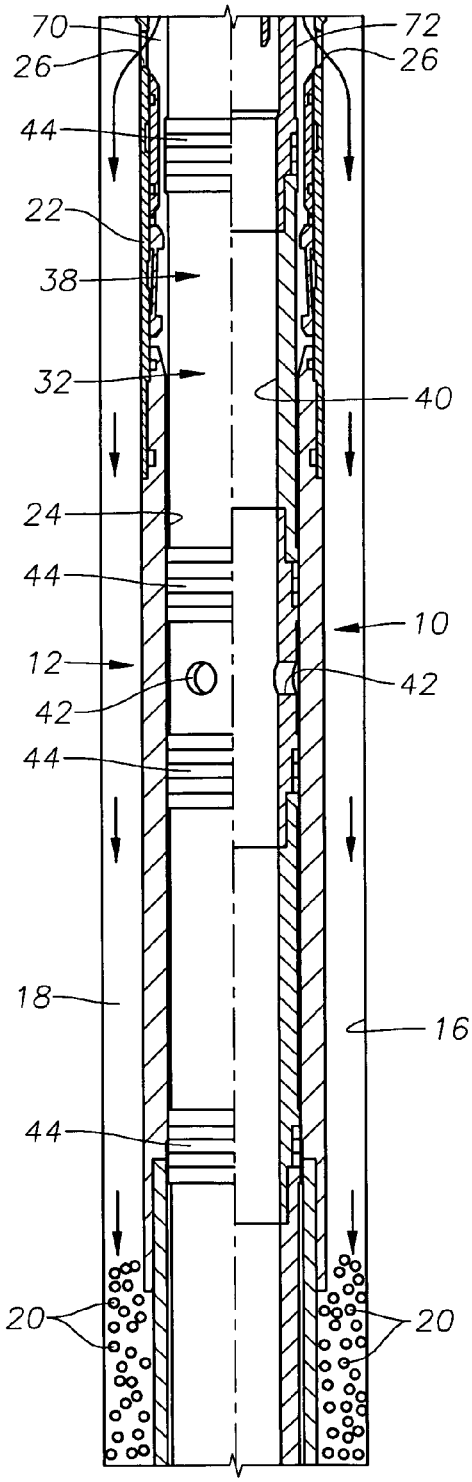

FIGS. 1*a* and 1*b* depict an exemplary solids placement system 10, which includes an extension sleeve assembly 12 that is secured to the lower end of a packer assembly 14. The exemplary solids placement system 10 is a system for the placement of gravel within a wellbore 16 during gravel packing. However, those of skill in the art will appreciate that a similar arrangement may be used for disposal of proppants and other solids within a wellbore. It is noted that the details of gravel packing and proppant placement operations generally are well known to those of skill in the art and, therefore, will not be described in detail herein. However, the general outline of an exemplary gravel packing tool and system 10 is described in order to illustrate one use of the blast liner assembly of the present invention.

The packer assembly 14 is a through-tubing packer assembly in that, once set, it can permit a service tool to be passed through its axial center. At the beginning of a gravel packing operation, the packer assembly 14 and extension sleeve assembly 12 are run into the wellbore 16. The packer assembly 14 is set against the cased side of the wellbore 16, and an annulus 18 is thereby defined between the extension sleeve assembly 12 and the side of the wellbore 16. In this situation, it is desired to place gravel 20 within the annulus 18 below the packer 14.

The extension sleeve assembly 12 has a generally cylindrical body 22 and defines an interior bore 24 with a pair of gravel flow ports 26 disposed therethrough. The extension sleeve assembly 12 also includes a blast liner retainer section, generally shown at 28. A rotatable blast liner 30, the structure and operation of which will be described shortly, is retained within the blast liner retainer section 28.

The solids placement system 10 also includes a service tool, generally shown at 32, which is disposed through the packer assembly 14 and into the bore 24 of the extension sleeve assembly 12. The service tool 32 is suspended upon a tubing string 34 that extends to the surface of the wellbore 16. The tubing string 34 defines an axial flowbore 36 along its length. The other portion of the service tool 32 is a gravel placement tool 38, which is secured to the lower end of the tubing string 34 and defines an axial, interior flowbore 40 along its length as well. Reverse recirculation ports 42 are disposed through a lower portion of the gravel placement tool 38. The use of such recirculation ports in gravel packing tools is well understood by those of skill in the art and, therefore, will not be described in any detail herein. Annular elastomeric seals 44 surround the gravel placement tool 38 at intervals along its length and serve to provide fluid sealing. The flowbore 40 of the gravel placement tool 38 contains a ball seat 46. Located just above the ball seat 46 is a lateral gravel flow port 48.

Figure 4:
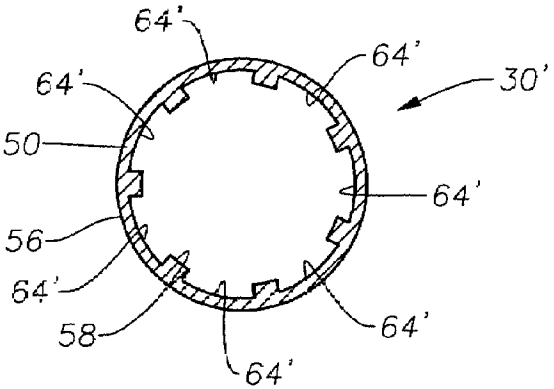
FIG. 4 is an axial cross-section of an alternative blast liner wherein the flow channels are formed by milling into the interior surface of the liner body.
Figure 2:
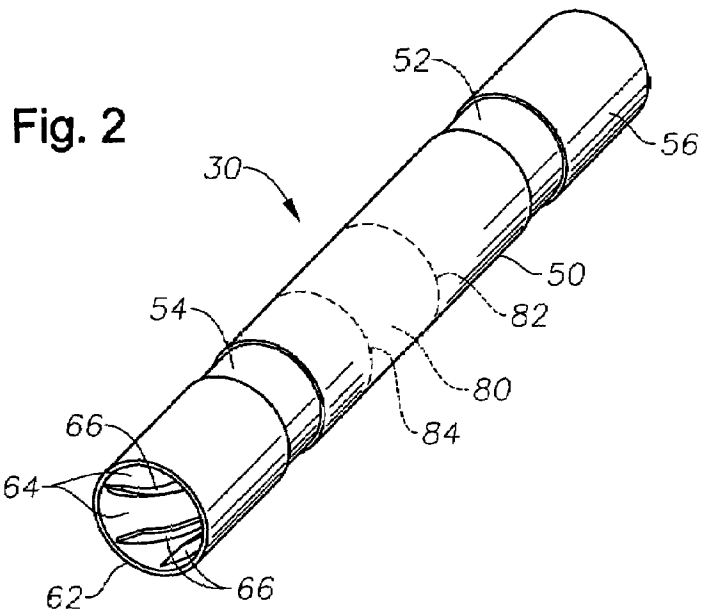
FIG. 2 is an isometric view of an exemplary blast liner constructed in accordance with the present invention.
Figure 3:
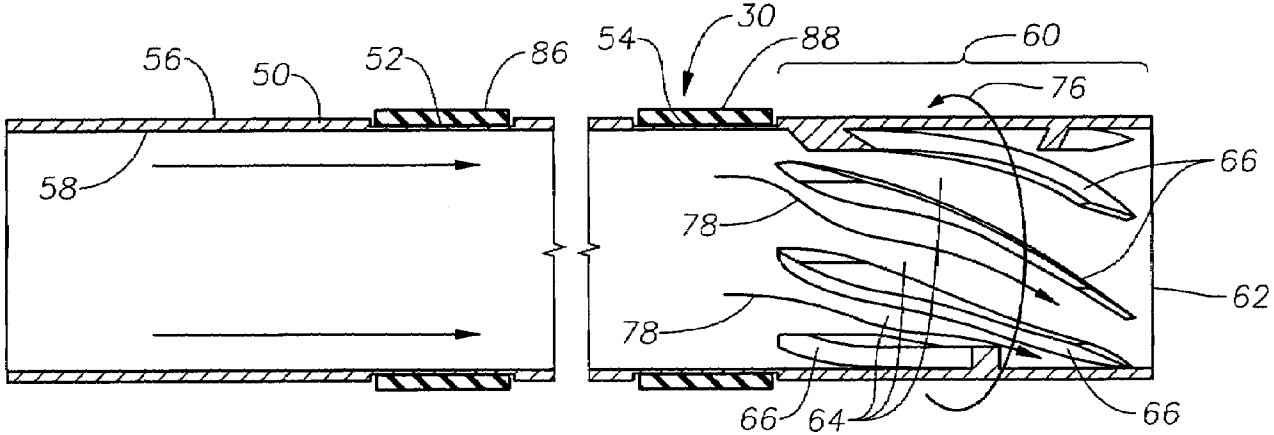
FIG. 3 is a side, cross-sectional view of the exemplary blast liner shown in FIG. 2.

Turning now to FIGS. 2, 3, and 4, the structure and operation of an exemplary rotatable blast liner 30 is now further described. FIGS. 2, 3, and 4 depict a blast liner 30 having a generally tubular liner body 50 with a pair of annular recessed portions 52, 54 upon the outer surface 56 of the blast liner 30. The radially inner surface 58 of the blast liner 30 includes a lower diversion portion 60 proximate the lower axial end 62 of the liner body 50. The diversion portion 60 features a plurality of angled flow channels 64. The flow channels 64 are formed between inwardly projecting vanes 66, as shown in FIGS. 2 and 3. Alternatively, flow channels may be formed by milling angled grooves 64' into the radially inner surface 58 of the blast liner body 50, as in alternative blast liner 30' illustrated in FIG. 4.

Referring again to FIGS. 1*a* and 1*b*, when the service tool 32 is disposed into the extension sleeve assembly 12, it is landed by the interengagement of landing shoulders (not shown), in a manner known in the art. When landed, the lateral gravel flow port 48 of the service tool 32 is located adjacent an upper portion of the rotatable blast liner 30. An annular space 70 is defined between the blast liner 30 and the outer radial surface 72 of the gravel placement tool 38. In order to begin placing gravel, a ball plug 74 is dropped into the flowbore 36 of the tubing string 34 and lands upon the ball seat 46. Once the ball plug 74 is seated, any fluids or slurries that are pumped down the flowbore 36 from the surface will be forced to exit the flowbore 36 through the gravel flow port 48.

In operation, flow of gravel slurry out of the gravel flow port 48 and through the annular space 70 to the gravel flow ports 26 will induce rotation of the blast liner 30 within the liner retaining section 28 in the direction opposite that in which the flow is being diverted by the diverter section 60 of the blast liner 30 due to the principal of equal and opposite reaction of forces. Arrow 76 in FIG. 3 illustrates the direction of the rotation of the blast liner 30, while arrows 78 in FIG. 3 illustrate the direction of diversion of slurry by the diversion portion 60. Rotation of the blast liner 30 within the liner retaining section 60 will prevent a single small area of the blast liner 30 from being exposed to the blast of slurry exiting the gravel flow port 48. Wear and abrasion damage will be spread substantially evenly about the circumference of the inner surface 58 of the blast liner 30 as the liner 30 is rotated, rather than the erosion wear being concentrated upon one angular area of the liner 30. As a result of the rotation of the liner 30, the life of the blast liner 30, and the solids placement system 10, overall, is extended as compared to a stationary sleeve, which would develop a hole at the point of impact. FIGS. 1*a* and 2 illustrate an exemplary annular primary wear, or impingement, area 80 having upper boundary 82 and lower boundary 84 upon the inner radial surface 58 of the blast liner 30. The primary wear area 80 is the portion of the inner radial surface 58 of the blast liner 30 that lies proximate the gravel flow port 48 and receives the primary erosion wear from gravel exiting the port 48. It is noted that annular bearings 86, 88, visible in FIG. 3 reside within the recessed portions 52, 54, respectively, to provide for standoff of the blast liner 30 from the liner retaining section 28 of the extension sleeve assembly 12 and helps ensure ease of rotation of the blast liner 30 within the liner retaining section 28.

Figure 5A:
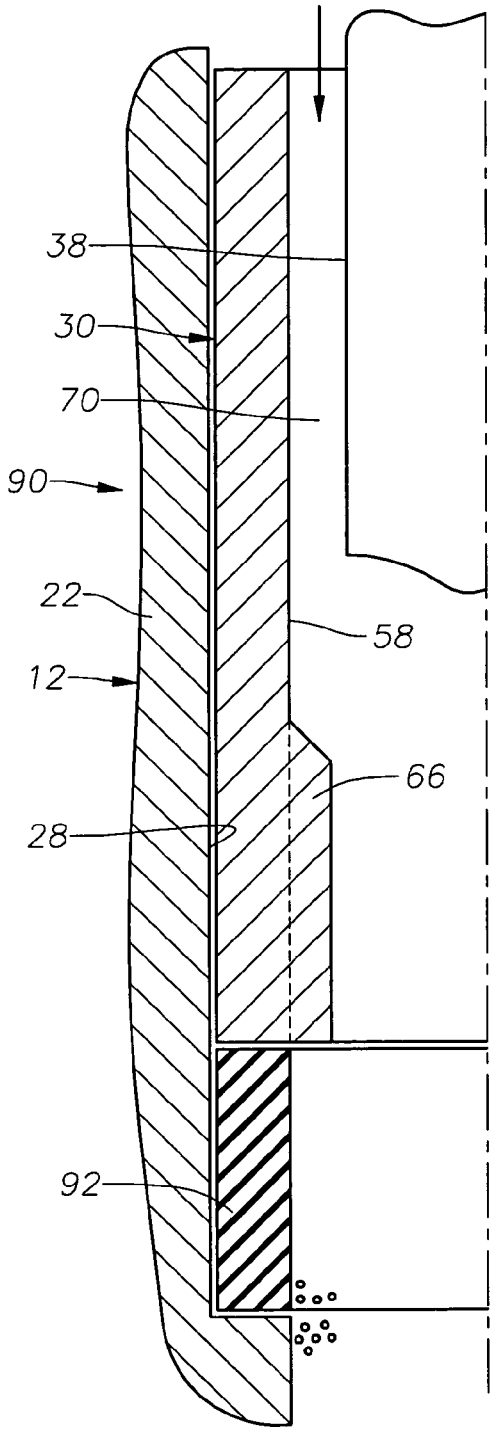
FIGS. 5*a* and 5*b* depict an alternative embodiment for an exemplary blast liner assembly constructed in accordance with the present invention, which incorporates a progressive wear member to permit axial travel of the blast liner.
Figure 5B:
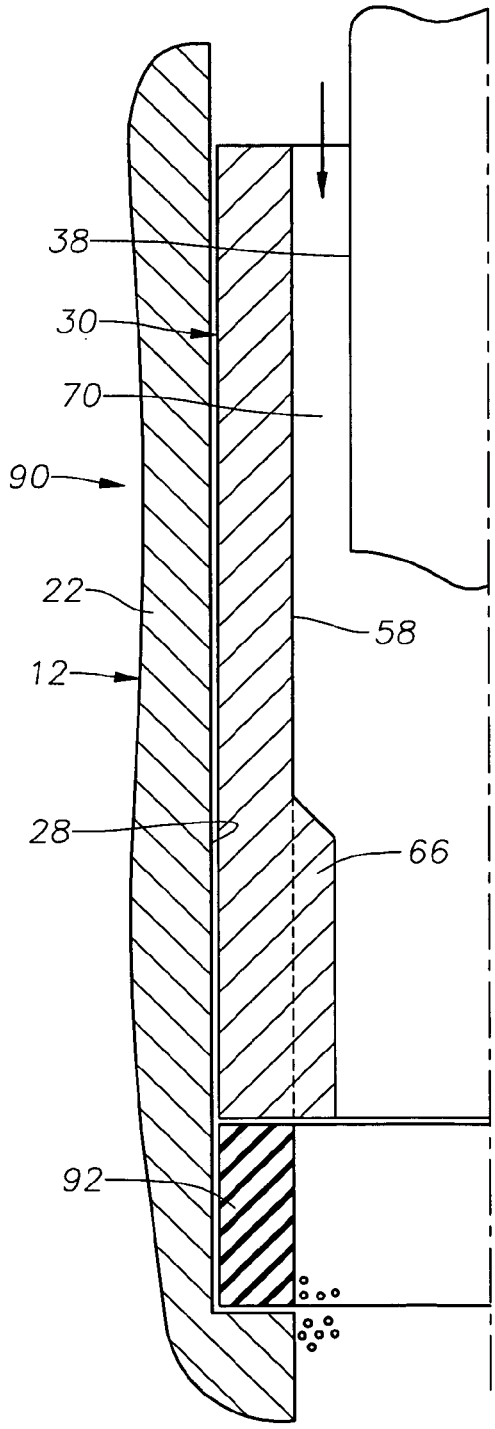

FIGS. 5*a* and 5*b* depict portions of an alternative embodiment for a blast liner assembly, generally indicated at 90, that is constructed in accordance with the present invention. The blast liner assembly 90 is used within the solids placement system 10 described earlier. In this embodiment, the blast liner 30, 30' is caused to move axially as well as rotationally within the liner retaining section 28 during use, thereby further increasing the area of the sleeve that is exposed to wear and abrasion damage. Because the damage is spread upon a larger area, there is less severe damage to any point area upon the sleeve.

The blast liner assembly 90 includes the blast liner 30 radially surrounding the gravel placement tool 38 and the liner retaining section 28 within the body 22 of the extension sleeve assembly 12. It is noted that, although a blast liner 30 is depicted in FIGS. 5*a* and 5*b*, a blast liner having milled grooves to form the flow channels, such as exemplary blast liner 30' might be used as well in the blast liner assembly 90. Additionally, the blast liner assembly 90 includes an erodable or wearable bushing 92 that is retained within the liner retaining section 28 below the blast liner 30. The wearable bushing 92 is formed of a readily erodable material, such as fiberglass, ceramic, or plastic. As the blast liner 30 (or 30') rotates within the liner retaining section 28, as described above, during flow of gravel slurry, the frictional engagement of the lower end of the blast liner 30 (or 30') with the bushing 92 will cause the bushing 92 to gradually wear away. FIG. 5*a* depicts the blast liner assembly 90 at the onset of flowing of gravel slurry, while FIG. 5*b* depicts the assembly after slurry has been flowed for a period of time. As can be seen by a comparison of FIGS. 5*a* and 5*b*, the bushing 92 has become much shorter axially due to the frictional wear upon it provided by the blast liner 30/30'. As a result, the blast liner 30/30' moves progressively downwardly within the liner retaining section 28. As the liner 30 or 30' moves downwardly within the liner retaining section 28, the annular impingement area 80 is expanded axially as the upper boundary 82 of the impingement area progressively moves upwardly upon the inner surface 58 of the liner body 50.

Figure 6:
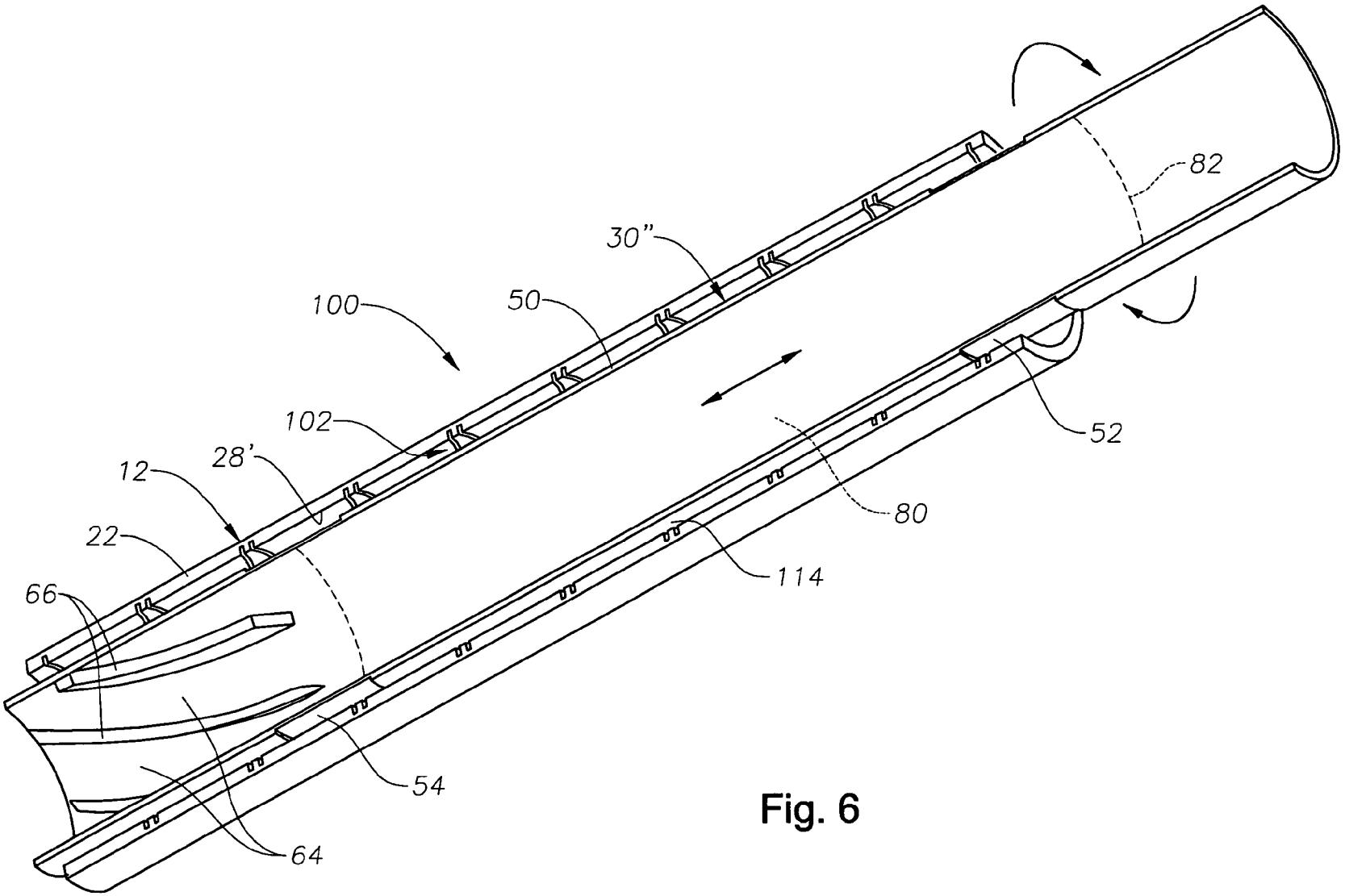
FIG. 6 is a side, cross-sectional view of an alternative embodiment for an exemplary blast liner assembly which incorporates a lug and track mechanism to permit liner movement of the blast liner during operation.
Figure 7:
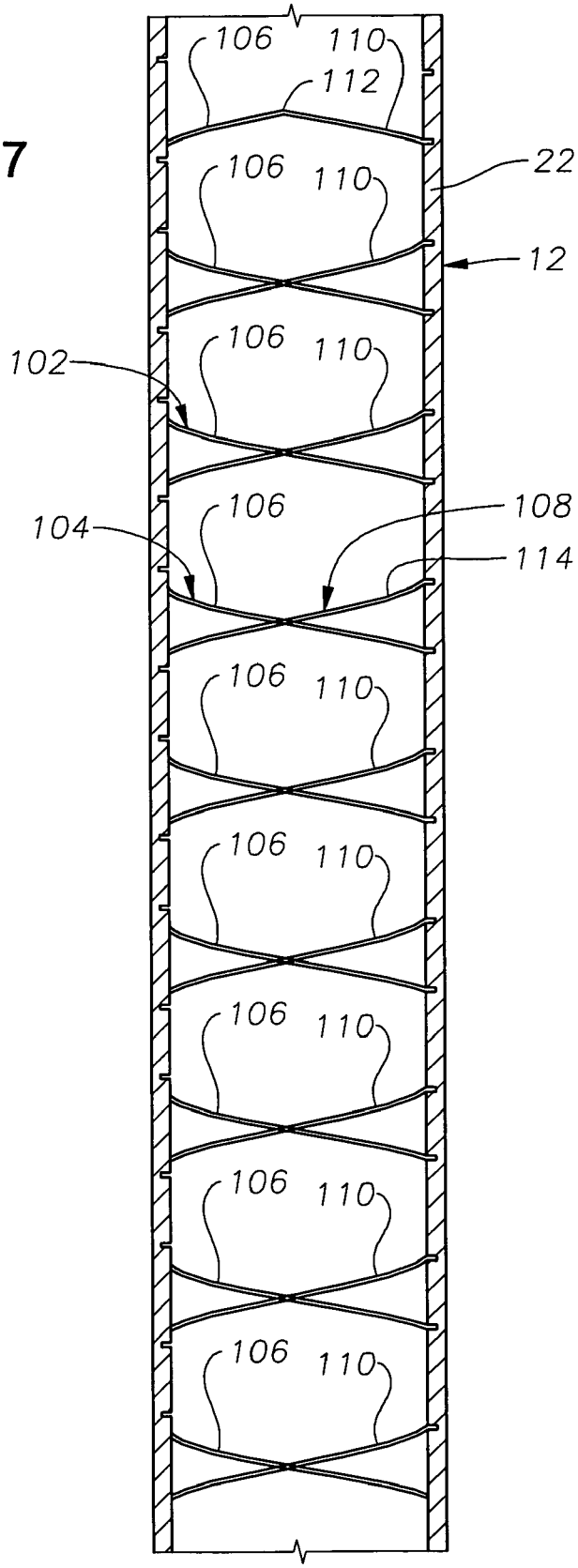
FIG. 7 is a side, cross-sectional view of the track mechanism for the assembly shown in FIG. 6.

Referring now to FIGS. 6 and 7, a further embodiment is depicted for a blast liner assembly 100 constructed in accordance with the present invention. The blast liner assembly 100 includes a blast liner 30" that is retained within the liner retaining section 28' of the extension sleeve assembly 12. The liner retaining section 28' is inscribed with a lug track 102, which is continuous. Details of the lug track 102 are better understood with reference to FIG. 7, which depicts the liner retaining section 28" in cross-section apart from other components. The lug track 102 of the liner retaining section 28" is essentially a double-helix that includes a first helical path 104 which, in the manner of a spring, is made up of individual spiral winds 106 that are sequentially disposed along the length of the retaining section 28". The winds 106 are formed in a first spiral direction. For example, as illustrated in FIG. 7, the path 104 and winds 106 proceed downwardly along the length of the retaining section 28" when traversed in a clockwise direction. The lug track 102 also includes a second helical path 108 that is inscribed within the retaining section 28". The second helical path 108 includes multiple individual spiral winds 110, which are oriented in a second spiral direction from the first winds 106. As depicted in FIG. 7, the second helical path 108 and winds 110 proceed axially upwardly along the length of the retaining section 28" when traversed in a clockwise direction. Both axial ends of the spiral paths 106, 110 are joined to one another at a joining point 112. Only one joining point 112 is depicted in FIG. 7. However, it will be understood that the opposite end of each spiral path 106 and 110 will be joined at a similar joining point at their opposite ends. As a result of the joining points 112, a continuous double-helical path is provided for the lug track 102. FIG. 6 illustrates that a lug 114 projects outwardly from the outer surface of the blast liner 30" and resides within the lug track 102. When the blast liner 30" is then rotated within the liner retaining section 28' by flow of slurry, as described previously, the lug 114 will be moved along the lug track 102 imparting axial movement to the blast liner 30". This axial movement of the liner 30" will cause the impingement area 80 to become axially larger. Approximate upper and lower boundaries 82, 84 of the annular impingement area 80 are illustrated in FIG. 6.

Those of skill in the art will recognize that the above-described devices and methods, although described in relation to a gravel packing arrangement, are also readily applicable to other solids placement arrangements, such as fracturing tools that place solid proppants within a wellbore. Those of skill in the art will also recognize that numerous modifications and changes may be made to the exemplary designs and embodiments described herein and that the invention is limited only by the claims that follow and any equivalents thereof.

What is claimed is:

1. A blast liner assembly for use in a solids placement tool within a wellbore, the blast liner assembly comprising:

a) an outer sleeve having a flow port therein;

b) a mandrel to be disposed within the outer sleeve , the mandrel defining an interior flowbore and an exit port; and c) a blast liner rotatably disposed within the outer sleeve to lie radially outside of the mandrel, the blast liner comprising:

(i) a body having a longitudinal axis and defining an interior flowspace with the mandrel; and (ii) a flow diverter within the interior flowspace that flows the slurry through the interior flowspace to rotate the blast liner.

2. The blast liner assembly of claim 1 wherein the flow diverter comprises a plurality of flow channels formed upon the body, flow channels being disposed upon the body at an acute angle with respect to the axis of the blast liner body.

3. The blast liner assembly of claim 2 wherein the flow channels comprise a plurality of inwardly projecting vanes.

4. The blast liner assembly of claim 2 wherein the flow channels comprise a plurality of milled grooves in the body.

5. The blast liner assembly of claim 1 further comprising a rotational bearing disposed between the blast liner and the outer sleeve.

6. The blast liner assembly of claim 1 wherein the blast liner moves axially with respect to the outer sleeve.

7. The blast liner assembly of claim 6 further comprising a progressively erodable bushing adjacent the blast liner that allows the blast liner to move axially with respect to the outer sleeve.

8. The blast liner assembly of claim 6 further comprising a lug and track mechanism adjacent the blast liner that allows the blast liner to move axially with respect to the outer sleeve.

9. The blast liner assembly of claim 1 wherein the blast liner comprises an annular reinforced impingement area upon an interior surface of the body.

10. A system for placement of solids within a wellbore comprising:

a) an extension sleeve assembly to be landed within a wellbore, the extension sleeve comprising:

(i) an outer sleeve having a solids flowport therein to be positioned for disposal of a solid-containing slurry within a wellbore;

(ii) a blast liner rotatably retained within the outer sleeve, the blast liner presenting a reinforced annular impingement area;

b) a service tool to be landed within the extension sleeve assembly, the service tool comprising:

(i) a solids placement tool defining a flowbore therewithin and a solids flowspace between an outer surface of the solids placement tool and the blast liner, the blast liner rotating in response to the slurry flow in the flowspace; and (ii) a solids exit port within the solids placement tool.

11. The system of claim 10 wherein the blast liner further comprises:

a tubular blast liner body having a longitudinal axis; and an angular flow diverter having a plurality of flow channels formed upon the blast liner body at an acute angle with respect to the axis of the blast liner body.

12. The system of claim 10 further comprising a progressively erodable bearing within the outer sleeve abutting an axial end of the blast liner body, the erodable bearing being progressively eroded upon rotation of the blast liner to permit the blast liner to move axially within the outer sleeve.

13. The system of claim 10 further comprising:

a radially outwardly projecting lug upon an outer surface of the blast liner; and a lug track inscribed within an inner surface of the outer sleeve to retain the lug such that rotational movement of the blast liner within the outer sleeve results in the blast liner being moved axially with respect to the outer sleeve.

14. The system of claim 13 wherein the lug track has a double-helical configuration.

15. A method for using a solids placement tool within a wellbore, comprising:

(a) positioning a blast liner assembly in the solids placement tool, the blast liner assembly including an outer sleeve having a flow port therein;

(b) disposing a mandrel within the outer sleeve, the mandrel defining an interior flowbore and an exit port;

(c) rotatably disposing a blast liner within the outer sleeve, the blast liner lying radially outside of the mandrel, the blast liner including a body having a longitudinal axis and defining an interior flowspace with the mandrel; and (d) flowing a slurry through the interior flowspace with a flow diverter, the flowing slurry rotating the blast liner.

16. The method of claim 15 further comprising forming a plurality of flow channels body on the body at an acute angle with respect to the axis of the blest liner body.

17. The method of claim 16 further comprising forming a plurality of inwardly projecting vanes along the flow channels.

18. The method of claim 16 further comprising milling a plurality of grooves in the body along the flow channels.

19. The method of claim 15 further comprising a disposing a rotational bearing between the blast liner and the outer sleeve.

20. The method of claim 15 further comprising moving the blast liner axially with respect to the outer sleeve.

21. The method of claim 20 further comprising positioning a progressively erodable bushing adjacent the blast liner that allows the blast liner to move axially with respect to the outer sleeve.

22. The method of claim 20 further comprising positioning a lug and track mechanism adjacent the blast liner that allows the blast liner to move axially with respect to the outer sleeve.

23. The blast liner assembly of claim 15 further comprising forming an annular reinforced impingement area upon an interior surface of the body.

* * * * *